US007306714B2

(12) United States Patent
Uzio et al.

(10) Patent No.: US 7,306,714 B2
(45) Date of Patent: Dec. 11, 2007

(54) PROCESS FOR HYDRODESULPHURIZING CUTS CONTAINING SULPHUR CONTAINING COMPOUNDS AND OLEFINS IN THE PRESENCE OF A SUPPORTED CATALYST COMPRISING GROUP VIII AND VIB ELEMENTS

(75) Inventors: Denis Uzio, Marly le Roi (FR); Stephane Cremer, Saint Germain en Laye (FR); Carine Petit-Clair, Montesson (FR); Nathalie Marchal-George, Saint Genis Laval (FR); Christophe Bouchy, Malmaison (FR); Florent Picard, Saint Symphorien D'O zon (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 287 days.

(21) Appl. No.: 10/449,714

(22) Filed: Jun. 2, 2003

(65) Prior Publication Data

US 2004/0007503 A1 Jan. 15, 2004

(30) Foreign Application Priority Data

Jun. 3, 2002 (FR) ..... 02/06.815

(51) Int. Cl.
*C10G 45/04* (2006.01)

(52) U.S. Cl. ..... 208/213; 208/209; 208/216 R; 208/217; 208/243; 208/244

(58) Field of Classification Search ..... 208/209, 208/213, 216 R, 217, 243, 244
See application file for complete search history.

(56) References Cited

U.S. PATENT DOCUMENTS

| | | | | |
|---|---|---|---|---|
| 6,174,443 | B1 * | 1/2001 | Ruckenstein et al. | 210/651 |
| 6,315,890 | B1 * | 11/2001 | Ladwig et al. | 208/67 |
| 6,610,197 | B2 * | 8/2003 | Stuntz et al. | 208/210 |
| 6,716,339 | B2 * | 4/2004 | Liu et al. | 208/208 R |
| 6,746,598 | B1 * | 6/2004 | Zanibelli et al. | 208/209 |

* cited by examiner

*Primary Examiner*—Tam M. Nguyen
(74) *Attorney, Agent, or Firm*—Millen, White, Zelano & Branigan, P.C.

(57) ABSTRACT

A process for hydrodesulphurizing gasoline cuts is carried out in the presence of a catalyst comprising at least one group VIII element, at least one group VIB element, and a support with a specific surface area of less than about 200 $m^2/g$, wherein the density of the group VIB elements per unit surface area of the support is in the range $4\times10^{-4}$ to $36\times10^{-4}$ g of group VIB element oxides per $m^2$ of the support.

22 Claims, No Drawings

PROCESS FOR HYDRODESULPHURIZING CUTS CONTAINING SULPHUR CONTAINING COMPOUNDS AND OLEFINS IN THE PRESENCE OF A SUPPORTED CATALYST COMPRISING GROUP VIII AND VIB ELEMENTS

This application relates to Applicants' concurrently filed application Ser. No. 10/449,725 entitled "Process For The Hydrodesulphurization Of Cuts Containing Sulphur Compounds And Olefins In The Presence Of A Catalyst Comprising An Element Of Group VIII And Tungsten".

The present invention relates to a catalyst comprising at least one support, at least one group VIB element and at least one group VIII element, permitting hydrodesulphurization of hydrocarbon feeds, preferably of the fluid catalytic cracking (FCC) type.

More particularly, the invention concerns a process for hydrodesulphurizing gasoline cuts in the presence of a catalyst comprising at least one group VIII element, at least one group VIB element, and a support with a specific surface area of less than about 200 $m^2/g$, in which the density of the group VIB elements per unit surface area of the support is in the range $4\times10^{-4}$ to $36\times10^{-4}$ g of group VIB element oxides per $m^2$ of the support.

PRIOR ART

Gasoline cuts, and more particularly gasoline from FCC, contain about 20% to 40% of olefinic compounds, 30% to 60% of aromatics and 20% to 50% of saturated paraffin or naphthenic type compounds. Of the olefinic compounds, branched olefins are in the majority over linear and cyclic olefins. Said gasoline also contains traces of highly unsaturated compounds of the diolefin type which tend to deactivate the catalysts by forming gums. European patent EP-B1-0 685 552 proposes selective hydrogenation of the diolefins, i.e., without transforming the olefins, before carrying out hydrotreatment to eliminate the sulphur. The amount of sulphur-containing compounds in said gasoline is highly variable and depends on-the type of gasoline (steam cracked, catalytically cracked, coking . . . ), or in the case of catalytic cracking on the severity of the process. It can fluctuate between 200 and 5000 ppm of S, preferably between 500 and 2000 ppm with respect to the weight of the feed. The families of the thiophenic and benzothiophenic compounds are in the majority, with mercaptans only being present in very small quantities generally in the range 10 to 100 ppm. FCC gasoline also contains nitrogen-containing compounds in proportions that generally do not exceed 100 ppm.

The production of reformulated gasoline satisfying new environmental regulations requires that the concentration of olefins be reduced as little as possible in order to keep the octane number high, but the sulphur content also has to be substantially reduced. Current and future environmental regulations will force refiners to reduce the sulphur content of gasoline to values of 50 ppm or less in 2003 and 10 ppm from 2005. Those regulations concern the total sulphur content and also the nature of the sulphur-containing compounds such as mercaptans. Catalytically cracked gasoline, which can represent 30% to 50% of the gasoline pool, have high olefin and sulphur contents. Almost 90% of the sulphur in reformulated gasoline can be ascribed to FCC gasoline. Desulphurization (hydrodesulphurization) of gasoline and mainly FCC gasoline is thus important in order to satisfy these specifications. Hydrotreatment (or hydrodesulphurization) of catalytically cracked gasolines, when carried out under conventional conditions that are known to the skilled person, can reduce the sulphur content of the cut. However, that process has the major disadvantage of causing a large decrease in the octane number of the cut due to saturation of the olefins during the hydrotreatment. Thus, processes have been proposed that can effect deep desulphurization of FCC gasoline while keeping the octane number high.

U.S. patent U.S. Pat. No. 5,318,690 proposes a process consisting of fractionating the gasoline, sweetening the light fraction and hydrotreating the heavy fraction over a conventional catalyst then treating it over a ZSM5 zeolite to substantially regain the initial octane number.

International patent application WO-A-01/40409 claims the treatment of a FCC gasoline under high temperature, low pressure and a high hydrogen/feed ratio conditions. Under those particular conditions, recombination reactions resulting in the formation of mercaptans, involving the $H_2S$ formed by the desulphurization reaction and the olefins, are minimized.

Finally, U.S. Pat. No. 5,968,346 proposes a process that can attain very low residual sulphur contents using a multistep process: hydrodesulphurization over a first catalyst, separation of the liquid and gas fractions, and a second hydrotreatment over a second catalyst. Liquid/gas separation can eliminate the $H_2S$ formed in the first reactor to result in a better compromise between hydrodesulphurization and octane number loss.

Obtaining the desired selectivity of the reaction (the ratio between hydrodesulphurization and hydrogenation of olefins) can thus in part be due to the choice of process but in all cases, the use of an intrinsically selective catalytic system is very often a key factor.

In general, the catalysts used for the above type of application are sulphide type catalysts containing an group VIB element (Cr, Mo, W) and an group VIII element (Fe, Ru, Os, Co, Rh, Ir, Pd, Ni, Pt). U.S. Pat. No. 5,985,136 claims that a catalyst with a surface concentration in the range $0.5\times10^{-4}$ to $3\times10^{-4}$ g $MoO_3/m^2$ can attain high selectivities for hydrodesulphurization (93% hydrodesulphurization (HDS) as opposed to 33% for olefin hydrogenation (HDO)). Further, according to U.S. Pat. No. 4,140,626 and U.S. Pat. No. 4,774,220, it may be advantageous to add a dopant (alkali, alkaline-earth) to the conventional sulphide phase (CoMoS) with the aim of limiting olefin hydrogenation.

A further manner of improving the intrinsic selectivity of catalysts is to exploit the presence of carbonaceous deposits on the catalyst surface. U.S. Pat. No. 4,149,965 proposes pre-treatment of a conventional naphtha hydrotreatment catalyst to partially deactivate it prior to its use in gasoline hydrotreatment. Similarly, EP-A1-0 745 660 indicates that pre-treatment of a catalyst in order to deposit 3% to 10% by weight of coke improves catalytic performance. In that case, it is stated that the C/H ratio must not exceed 0.7.

SUMMARY OF THE INVENTION

In the present invention, we have discovered a catalyst that can be used in a gasoline hydrodesulphurization process that can reduce the total sulphur and mercaptans content of hydrocarbon cuts, preferably FCC cuts, without a substantial loss of gasoline and minimizing the reduction in octane number.

More particularly, the invention concerns a process for hydrodesulphurizing gasoline cuts carried out in the presence of a catalyst comprising at least one group VIII element, at least one group VIB element, and a support with a specific surface area of less than about 200 $m^2/g$, in which the density of group VIB elements per unit surface area of the support is in the range $4\times10^{-4}$ to 36×10-4 g of group VIB element oxides per $m^2$ of the support.

DETAILED DESCRIPTION OF THE INVENTION

The feed to be hydrotreated (or hydrodesulphurized) using the process of the invention is generally a sulphur-containing gasoline cut, such as a cut from a coking unit, a visbreaking unit, a steam cracking unit or from fluid catalytic cracking FCC. Said feed is preferably constituted by a gasoline cut derived from a catalytic cracking unit with a boiling point range that typically extends from the boiling point of hydrocarbons containing 5 carbon atoms to about 250° C. Said gasoline can optionally be composed of a significant fraction of the gasoline from other production processes such as atmospheric distillation (straight run gasoline) or from conversion processes (coking or steam cracked gasoline).

The hydrodesulphurization catalysts of the invention are catalysts comprising at least one group VIB element and at least one group VIII element on a suitable support. The group VIB element or elements is/are preferably selected from molybdenum and/or tungsten and the group VIII element or elements is/are preferably selected from nickel and/or cobalt. The catalyst support is normally a porous solid selected from the group formed by: aluminas, silica, silica alumina or titanium or magnesium oxides used alone or as a mixture with alumina or silica alumina. It is preferably selected from the group formed by: silica, the transition aluminas and silica aluminas; more preferably, the support is essentially constituted by at least one transition alumina, i.e., it comprises at least 51% by weight, preferably at least 60% by weight and more preferably at least 80% by weight, or even at least 90% by weight of transition alumina. Optionally, it can be exclusively constituted by a transition alumina.

The specific surface area of the support of the invention is generally less than about 200 $m^2/g$, preferably less than 170 $m^2/g$ and more preferably less than 150 $m^2/g$ or even less than 135 $m^2/g$. The support can be prepared using any precursor, any preparation method and any forming tool that is known to the skilled person.

The catalyst of the invention can be prepared using any technique that is known to the skilled person, in particular by impregnating the group VIII and VIB elements onto the selected support. Said impregnation can, for example, be carried out in a manner that is known as dry impregnation to the skilled person, in which just the desired quantity of the elements is introduced in the form of soluble salts into the selected solvent, for example demineralized water, to fill the pores of the support as exactly as possible. The support filled by the solution is then preferably dried.

After introducing the group VIII and VIB elements and optional forming of the catalyst, it undergoes an activation treatment. Said treatment is generally intended to transform the molecular precursors of the elements into the oxide phase (for example $MoO_3$). In that case, it is an oxidizing treatment, but direct reduction can also be carried out. In the case of an oxidizing treatment, also known as calcining, this is generally carried out in air or diluted oxygen, and the treatment temperature is generally in the range 200° C. to 550° C., preferably in the range 300° C. to 500° C. A reducing treatment is generally carried out in pure or, as is preferable, diluted hydrogen, and the treatment temperature is generally in the range 200° C. to 600° C., preferably in the range 300° C. to 500° C.

Examples of salts of group VIB and VIII metals that can be used in the process of the invention are cobalt nitrate, aluminium nitrate, ammonium heptamolybdate and ammonium metatungstate. Any other salt that is known to the skilled person having sufficient solubility and which will decompose during the activation treatment can also be used.

The catalyst is normally used in the sulphide form obtained after heat treatment in contact with a decomposable organic sulphur-containing compound that generates $H_2S$ or obtained directly by contact with a stream of gaseous $H_2S$ diluted in $H_2$. This step can be carried out in situ or ex situ (within or outside the reactor) with respect to the hydrodesulphurization reactor at temperatures in the range 200° C. to 600° C., more preferably in the range 300° C. to 500° C.

The density of the group VIB elements (chromium, molybdenum, tungsten) in the catalysts of the invention is in the range $4\times10^{-4}$ to $36\times10^{-4}$ g of the group VIB element oxide per $m^2$ of support, preferably in the range $4\times10^{-4}$ g to $16\times10^{-4}$ of group VIB element oxide per $m^2$ of support, and more preferably in the range $7\times10^{-4}$ g to $15\times10^{-4}$ g of the group VIB element oxide per $m^2$ of support. The specific surface area of the support generally must not exceed about 200 $m^2/g$, and preferably must be less than 170 $m^2/g$, more preferably less than 150 $m^2/g$, still more preferably less than 135 $m^2/g$.

It should be noted that the two criteria must generally be satisfied simultaneously, as a synergistic effect exists between said two parameters.

Without wishing to be bound by any particular theory, the group VIB element and its surface distribution are involved in the activation and reactivity of the molecules. It should be noted that the two criteria must in general be satisfied simultaneously, as a synergistic effect exists between said two parameters as regards the activation and reactivity of the molecules. Further, in the presence of the group VIII and VIB elements (also termed metals), the surface of the support can play an important role in the mechanism of activation and surface migration of the molecules, in particular olefins, as recently proposed [R Prins, Studies in Surface Science and Catalysis 138, p. 1-2]. Minimizing this activation process could possibly limit reactions employing olefinic compounds: hydrogenation by addition of hydrogen (deleterious to keeping the octane number high) and recombination with $H_2S$ (deleterious to desulphurization).

Further, using a high specific surface area is problematical in the case of a highly olefinic feeds. Since surface acidity increases with the specific surface area of supports, acid catalyzed reactions will be favoured with supports with a high specific surface area. Polymerization or coking reactions resulting in the formation of gums or coke and finally the premature deactivation of the catalyst will be more significant on supports with a high specific surface area. Better catalyst stability will be obtained for supports with a lower specific surface area.

The amount of group VIII elements in the catalyst of the invention is preferably in the range 1% to 20% by weight of group VIII element oxides, preferably in the range 2% to 10% by weight of group VIII element oxides and more preferably in the range 2% o 8% by weight of group VIII element oxides. Preferably, the group VIII element is cobalt or nickel or a mixture of the two elements, and more preferably the group VIII element is constituted exclusively by cobalt or nickel.

The amount of group VIB elements is preferably in the range 1.5% to 60% by weight of group VIB element oxides, more preferably in the range 3% to 50% by weight of group VIB element oxides. Preferably, the group VIB element is molybdenum or tungsten or a mixture of said two elements, and more preferably the group VIB element is constituted exclusively by molybdenum or tungsten.

The catalyst of the invention can be used in any process that is known to the skilled person that can desulphurize fluid catalytic cracking (FCC) type hydrocarbon cuts, for example by maintaining the octane number at high values. It can be carried out in any type of reactor operated in fixed bed or moving bed or ebullated bed mode; preferably, however, it is preferably used in a reactor operated in fixed bed mode.

By way of indication, the operating conditions allowing selective hydrodesulphurization of catalytically cracked gasoline are: a temperature in the range from about 200° C. to about 400° C., preferably in the range from about 250° C. to about 350° C., a total pressure in the range 1 MPa to 3 MPa and more preferably between about 1 MPa to about 2.5 MPa, with a volume of hydrogen per volume of hydrocarbon feed ratio in the range from about 100 to about 600 liters per liter, more preferably between about 200 and about 400 liters per liter. Finally, the hourly space velocity (HSV) is the inverse of the contact time, expressed in hours. It is defined as the ratio between the volume flow rate of the liquid hydrocarbon feed and the volume of catalyst loaded into the reactor.

EXAMPLES

Catalyst Preparation

All of the molybdenum-based catalysts were prepared using the same method, which consisted of carrying out dry impregnation with a solution of ammonium heptamolybdate and cobalt nitrate, the volume of the solution containing the metal precursors being rigorously equal to the pore volume of the support mass. The supports employed were transition aluminas with different specific surface areas and pore volumes: 130 $m^2/g$ and 1.04 $cm^3/g$; 170 $m^2/g$ and 0.87 $cm^3/g$; 220 $m^2/g$ and 0.6 $cm^3/g$; 60 $m^2/g$ and 0.59 $cm^3/g$. The concentrations of precursors in the aqueous solution were adjusted to deposit the desired amounts by weight on the support. The catalyst was then dried for 12 hours at 120° C., and calcined in air at 500° C. for 2 hours.

All of the tungsten-based catalysts were prepared using the same method, which consisted of dry impregnating with a solution of ammonium metatungstate and cobalt nitrate, the volume of the solution containing the metal precursors being rigorously equal to the pore volume of the support mass. The supports employed were the same as above. The concentrations of precursors in the aqueous solution were adjusted to deposit the desired amounts by weight on the support. The catalyst was then dried for 12 hours at 120° C., and calcined in air at 500° C. for 2 hours.

Evaluation of Catalyst Performance:

A catalytically cracked gasoline (FCC) with the characteristics shown in Table 1 was treated using different catalysts. The reaction was carried out by varying the temperature of the traversed bed type reactor operated under the following conditions: P=2 MPa, $H_2$/HC=300 liters/liter of hydrocarbon feed, the temperature being fixed at 280° C. for molybdenum-based catalysts and 300° C. for tungsten-based catalysts. The HSV was variable in order to compare the selectivities obtained ($k_{HDS}/k_{HDO}$) for HDS isoconversion, namely for a hydrodesulphurization conversion of about 90% for all of the catalysts. The catalysts were pre-treated at 350° C. with a feed containing 4% by weight of sulphur in the form of DMDS (dimethyldisulphide) to ensure sulphurization of the oxide phases. The reaction was carried out in upflow mode in an adiabatic tube reactor. In all cases, an analysis of the residual organic sulphur-containing compounds was carried out after eliminating $H_2S$ resulting from decomposition. The effluents were analyzed by gas chromatography to determine the hydrocarbon concentrations, and using the method described in French standard NF M 07075 to determine the total sulphur. The results are expressed as the rate ratio $k_{HDS}/k_{HDO}$, assuming a first order reaction for the sulphur-containing compounds for the hydrodesulphurization (HDS) reaction and a zero order reaction with respect to the olefins for the olefin hydrogenation reaction (HDO). For catalysts based on molybdenum or tungsten, the values were normalized by taking catalyst 2 or catalyst 12 as the reference respectively. These values are given after 96 hours and 200 hours of operation in order to take into account the initial activity and deactivation.

TABLE 1

| Characteristics of the FCC gasoline cut | |
|---|---|
| S ppm | 732 |
| Aromatics, % by weight | 31.4 |
| Paraffins, % by weight | 30.4 |
| Napthenes, % by weight | 6.7 |
| Olefins, % by weight | 31.5 |
| IP, ° C. | 70.5 |
| EP, ° C. | 215.4 |

Example 1 (in Accordance with the Invention)

The molybdenum-based catalysts in accordance with the invention were prepared using the procedure described above and their characteristics (density, in grams of molybdenum oxide per square meter of support, cobalt and molybdenum oxide contents in the calcined catalyst, BET surface area of the support) are shown in Table 2. The $k_{HDS}/k_{HDO}$ selectivities obtained for an HDS conversion of close to 90% at the HSV mentioned are also shown in this table.

TABLE 2 characteristics and performances of molybdenum-based catalysts of the invention

| Catalyst | Density g $MoO_3/m^2$ | CoO wt % | $MoO_3$ wt % | S BET $m^2/g$ | HSV $h^{-1}$ | $k_{HDS}/k_{HDO}$ t = 96 h | $k_{HDS}/k_{HDO}$ t = 200 h |
|---|---|---|---|---|---|---|---|
| 1 | $4.3 \times 10^{-4}$ | 1.8 | 5.2 | 130 | 3.8 | 0.94 | 0.85 |
| 2 | $7.7 \times 10^{-4}$ | 3.1 | 8.8 | 130 | 4.0 | 1 | 0.94 |
| 3 | $14.8 \times 10^{-4}$ | 5.3 | 15.3 | 130 | 5.3 | 1.32 | 1.21 |
| 4 | $35.8 \times 10^{-4}$ | 5.8 | 16.7 | 60 | 3.4 | 0.85 | 0.81 |
| 5 | $7.6 \times 10^{-4}$ | 3.8 | 11.0 | 170 | 3.1 | 0.78 | 0.71 |
| 6 | $16.5 \times 10^{-4}$ | 5.8 | 16.6 | 130 | 3.3 | 0.82 | 0.74 |

Example 2 (Comparative)

In this example, the density of molybdenum was modified to place it outside the density range of the invention. The test HSV was also selected in order to operate with an HDS conversion of substantially 90%. Table 3 summarizes the characteristics of the catalysts and the selectivities obtained.

TABLE 3 characteristics and performances of comparative molybdenum-based catalysts tested on a catalytically cracked gasoline

| Catalyst | Density g $MoO_3/m^2$ | CoO wt % | $MoO_3$ wt % | S BET $m^2/g$ | HSV $h^{-1}$ | $k_{HDS}/k_{HDO}$ t = 96 h | $k_{HDS}/k_{HDO}$ t = 200 h |
|---|---|---|---|---|---|---|---|
| 7 | $2.8 \times 10^{-4}$ | 1.2 | 3.5 | 130 | 2.4 | 0.59 | 0.56 |
| 8 | $37.1 \times 10^{-4}$ | 10.2 | 29.2 | 130 | 7.0 | 0.65 | 0.61 |

Example 3 (Comparative)

In this example, the specific surface area of the support was modified so as to be over 200 $m^2/g$. The HSV of the test was also selected so as to operate with an HDS conversion of substantially 90%. Table 4 summarizes the characteristics of the catalysts and the selectivities obtained.

TABLE 4 characteristics and performances of comparative molybdenum-based catalysts on a catalytically cracked gasoline

| Catalyst | Density g $MoO_3/m^2$ | CoO wt % | $MoO_3$ wt % | S BET $m^2/g$ | HSV $h^{-1}$ | $k_{HDS}/k_{HDO}$ t = 96 h | $k_{HDS}/k_{HDO}$ t = 200 h |
|---|---|---|---|---|---|---|---|
| 9 | $7.9 \times 10^{-4}$ | 4.9 | 14.1 | 220 | 3.5 | 0.67 | 0.63 |
| 10 | $4.3 \times 10^{-4}$ | 2.9 | 8.4 | 220 | 1.6 | 0.40 | 0.33 |

Example 4 (in Accordance with the Invention)

The tungsten-based catalysts in accordance with the invention were prepared using the procedure described above and their characteristics (density, in grams of tungsten oxide per square meter of support, cobalt and tungsten oxide contents in the calcined catalyst, BET surface area of the support) are shown in Table 5. The $k_{HDS}/k_{HDO}$ selectivities obtained for an HDS conversion of close to 90% at the HSV mentioned are also shown in this table.

TABLE 5 characteristics and performances of tungsten-based catalysts of the invention

| Catalyst | Density g $WO_3/m^2$ | CoO wt % | $WO_3$ wt % | S BET $m^2/g$ | HSV $h^{-1}$ | $k_{HDS}/k_{HDO}$ t = 96 h | $k_{HDS}/k_{HDO}$ t = 200 h |
|---|---|---|---|---|---|---|---|
| 11 | $4.5 \times 10^{-4}$ | 1.2 | 5.5 | 130 | 1.5 | 0.93 | 0.88 |
| 12 | $8.0 \times 10^{-4}$ | 2.0 | 9.2 | 130 | 3.0 | 1.00 | 0.95 |
| 13 | $14.5 \times 10^{-4}$ | 3.3 | 15.3 | 130 | 3.7 | 1.18 | 1.10 |
| 14 | $35.5 \times 10^{-4}$ | 3.6 | 16.9 | 60 | 3.5 | 0.80 | 0.74 |
| 15 | $8.2 \times 10^{-4}$ | 2.6 | 11.9 | 170 | 3.2 | 0.88 | 0.82 |
| 16 | $16.2 \times 10^{-4}$ | 3.6 | 16.8 | 130 | 4.0 | 0.86 | 0.81 |

Example 5 (Comparative)

In this example, the density of the tungsten oxide was modified to place it outside the density range of the invention. The test HSV was also selected in order to operate with an HDS conversion of substantially 90%. Table 6 summarizes the characteristics of the catalysts and the selectivities obtained.

TABLE 6 characteristics and performances of comparative tungsten-based catalysts tested on a catalytically cracked gasoline

| Catalyst | Density g $WO_3/m^2$ | CoO wt % | $WO_3$ wt % | S BET $m^2/g$ | HSV $h^{-1}$ | $k_{HDS}/k_{HDO}$ t = 96 h | $k_{HDS}/k_{HDO}$ t = 200 h |
|---|---|---|---|---|---|---|---|
| 17 | $3.1 \times 10^{-4}$ | 0.8 | 3.8 | 130 | 1.2 | 0.64 | 0.59 |
| 18 | $38.0 \times 10^{-4}$ | 6.6 | 30.9 | 130 | 6.5 | 0.60 | 0.55 |

Example 6 (Comparative)

In this example, the specific surface area of the support was modified so as to be over 200 m 2/g. The HSV of the test was also selected so as to operate with an HDS conversion of substantially 90%. Table 7 summarizes the characteristics of the catalysts and the selectivities obtained.

TABLE 7 characteristics and performances of comparative tungsten-based catalysts tested on a catalytically cracked gasoline

| Catalyst | Density g $WO_3/m^2$ | CoO wt % | $WO_3$ wt % | S BET $m^2/g$ | HSV $h^{-1}$ | $k_{HDS}/k_{HDO}$ t = 96 h | $k_{HDS}/k_{HDO}$ t = 200 h |
|---|---|---|---|---|---|---|---|
| 19 | $8.4 \times 10^{-4}$ | 3.2 | 15.1 | 220 | 3.6 | 0.76 | 0.69 |
| 20 | $4.3 \times 10^{-4}$ | 1.8 | 8.5 | 220 | 2.7 | 0.70 | 0.64 |

The preceding examples can be repeated with similar success by substituting the generically or specifically described reactants and/or operating conditions of this invention for those used in the preceding examples.

The entire disclosures of all applications, patents and publications, cited herein and of corresponding French application No. 02/06.815, filed Jun. 3, 2002 is incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process comprising hydrodesulphurizing gasoline cuts in the presence of a catalyst comprising at least one group VIII element in an amount in the range of 1-20% by weight of the group VIII element oxides, at least one group VIB element, and a support with a specific surface area of less than about 135 $m^2/g$, in which the density of the group VIB elements per unit surface area of the support is in the range of $4\times10^{-4}$ to $16\times10^{-4}$ g of group VIB element oxides per $m^2$ of the support, said hydrodesulfurizing being conducted at a temperature of 200-400° C., a pressure of 1 to 2.5 MPa and a hydrogen to gasoline volumetric ratio of 200 to 400 liters of hydrogen per liter of gasoline cuts.

2. A hydrodesulphurization process according to claim 1, wherein the amount of group VIII elements in the catalyst is in the range 2% to 10% by weight of group VIII element oxides and the amount of group VIB elements is in the range 1.5% to 60% by weight of group VIB element oxides.

3. A process according to claim 1, wherein the catalyst comprises at least one group VIII element selected from nickel and cobalt.

4. A process according to claim 1, wherein the catalyst comprises at least one group VIB element selected from molybdenum and tungsten.

5. A process according to claim 1, wherein the catalyst support is a porous solid selected from the group consisting of: aluminas, silica, silica alumina or titanium or magnesium oxides used alone or as a mixture with alumina or silica alumina.

6. A process according to claim 1, wherein the catalyst support comprises at least 90% by weight of transition alumina.

7. A process according to claim 1, wherein the feed to be hydrodesulphurized is a gasoline cut containing sulphur from a coking, visbreaking, steam cracking or catalytic cracking unit.

8. A process according to claim 1, wherein the feed to be hydrodesulphurized is a gasoline cut from a catalytic cracking unit with a boiling point range from about the boiling point of hydrocarbons containing 5 carbon atoms to about 250° C.

9. A hydrodesulphurization process according to claim 1, wherein the amount of group VIII elements in the catalyst is in the range 2% to 10% by weight of group VIII element oxides and the amount of group VIB elements is in the range 1.5% to 60% by weight of group VIB element oxides.

10. A process according to claim 3, wherein the catalyst comprises at least one group VIB element selected from molybdenum and tungsten.

11. A hydrodesulphurization process according to claim 10, wherein the amount of group VIII elements in the catalyst is in the range 2% to 10% by weight of group VIII element oxides and the amount of group VIB elements is in the range 1.5% to 60% by weight of group VIB element oxides.

12. A process according to claim 11, wherein the catalyst support comprises at least 90% by weight of transition alumina.

13. A process according to claim 12, wherein the feed to be hydrodesulphurized is a gasoline cut from a catalytic cracking unit with a boiling point range from about the boiling point of hydrocarbons containing 5 carbon atoms to about 250° C.

14. A hydrodesulphurization process according to claim 1, in which the density of the group VIB elements per unit surface area of the support is in the range $7\times10^{-4}$ g to $15\times10^{-4}$ g of group VIB element oxides per $m^2$ of support.

15. A hydrodesulphurization process according to claim 13, in which the density of the group VIB elements per unit surface area of the support is in the range $7\times10^{-4}$ g to $15\times10^{-4}$ g of group VIB element oxides per $m^2$ of support.

16. A process according to claim 1, wherein said support consists of a member selected from the group consisting of silica, a silica-alumina, and a transition alumina, and said catalyst consists of said at least one group VIII element, said at least one group VIII element and said support.

17. A process according to claim 16, wherein the feed to be hydrodesulphurized is a gasoline cut from a catalytic cracking unit with a boiling point range from about the boiling point of hydrocarbons containing 5 carbon atoms to about 250° C.

18. A process according to claim 17, wherein the group VIB element is molybdenum or tungsten.

19. A process according to claim 3, wherein the Group VIB element is molybdenum.

20. A process according to claim 19, wherein the catalyst support is a porous solid selected from the group consisting of: aluminas, silica, silica alumina or titanium or magnesium oxides used alone or as a mixture with alumina or silica alumina.

21. A process according to claim 1, wherein the specific area of the support is about 130 $m^2/g$ or less.

22. A process according to claim 1, wherein the specific area of the support is about 130 $m^2/g$.

* * * * *

UNITED STATES PATENT AND TRADEMARK OFFICE

CERTIFICATE OF CORRECTION

PATENT NO. : 7,306,714 B2
APPLICATION NO. : 10/449714
DATED : December 11, 2007
INVENTOR(S) : Denis Uzio It is certified that error appears in the above-identified patent and that said Letters Patent is hereby corrected as shown below:

Column 10, line 17 reads "VIII", should read --VIB--

Signed and Sealed this

Seventeenth Day of June, 2008

JON W. DUDAS
*Director of the United States Patent and Trademark Office*